US008127826B2

(12) United States Patent
Hohenbichler et al.

(10) Patent No.: US 8,127,826 B2
(45) Date of Patent: Mar. 6, 2012

(54) METHOD FOR PRODUCING A CAST STEEL STRIP

(75) Inventors: Gerald Hohenbichler, Kronstorf (AT); Gerald Eckerstorfer, Linz (AT); Michael Zahedi, St Marien (AT)

(73) Assignee: Siemens Vai Metals Technologies GmbH (AT)

( * ) Notice: Subject to any disclaimer, the term of this patent is extended or adjusted under 35 U.S.C. 154(b) by 0 days.

(21) Appl. No.: 12/630,452

(22) Filed: Dec. 3, 2009

(65) Prior Publication Data

US 2010/0078146 A1 Apr. 1, 2010

Related U.S. Application Data

(63) Continuation of application No. 11/718,084, filed as application No. PCT/EP2005/010130 on Sep. 20, 2005, now abandoned.

(30) Foreign Application Priority Data

Oct. 29, 2004 (AT) ..... 1823/2004

(51) Int. Cl.
*B22D 11/22* (2006.01)

(52) U.S. Cl. ..... 164/455

(58) Field of Classification Search ..... 164/455
See application file for complete search history.

(56) References Cited

U.S. PATENT DOCUMENTS

| | | | |
|---|---|---|---|
| 5,049,204 | A | 9/1991 | Iwanaga et al. |
| 5,960,856 | A | 10/1999 | Blejde et al. |
| 2002/0043358 | A1 | 4/2002 | Strezov et al. |

FOREIGN PATENT DOCUMENTS

| | | |
|---|---|---|
| DE | 197 57 704 | 7/1998 |
| EP | 0 530 675 | 3/1993 |

(Continued)

OTHER PUBLICATIONS

Machine Translation of DE 19757704 which originally published Jul. 30, 1998.*

(Continued)

*Primary Examiner* — Jessica L Ward
*Assistant Examiner* — Nicolas D'Aniello
(74) *Attorney, Agent, or Firm* — Ostrolenk Faber LLP

(57) ABSTRACT

The invention relates to a method for producing a cast steel strip of preferably hot crack-sensitive or hot-brittle steel quality by means of a strip casting plant and to a strip casting plant for carrying out this method. In this case, steel melt is conducted into a melt space formed by two casting rolls and two sideplates, slab shells are formed in the melt space on cooled surface areas of the casting rolls and are brought together in the strip forming cross section between the casting rolls to form an at least partly solidified steel strip, the cast steel strip is then guided along the surface area of one of the two casting rolls from a vertical casting direction into an essentially horizontal transport direction, and the cast steel strip is supplied essentially horizontally on a transport device to a strip winding device and is wound there into a coil. In order in this case to minimize susceptibility to crack formation, the cast steel strip, during its transport movement along the surface area of one of the two casting rolls, is guided in a transport channel without the application of deformation forces influencing the strip thickness and is subjected in this region to strip cooling of less than 200 K/s.

18 Claims, 1 Drawing Sheet

FOREIGN PATENT DOCUMENTS

| | | | |
|---|---|---|---|
| JP | 61 189852 | | 8/1986 |
| JP | 63 068248 | | 3/1988 |
| JP | 1087045 | | 3/1989 |
| JP | 01 133651 | A | 5/1989 |
| JP | 02 247049 | | 10/1990 |
| JP | 2290651 | | 11/1990 |
| JP | 02 295649 | | 12/1990 |
| JP | 04 266458 | | 9/1992 |
| JP | 04 319046 | | 11/1992 |
| JP | 05200498 | A * | 8/1993 |
| WO | WO 02/24969 | | 3/2002 |
| WO | WO 2004/028725 | | 4/2004 |

OTHER PUBLICATIONS

Machine Translation of JP 05200498 A, which published Aug. 1993.*

International Search Report PCT/EP2005/010130 dated Nov. 22, 2005.

* cited by examiner

METHOD FOR PRODUCING A CAST STEEL STRIP

CROSS REFERENCE TO RELATED APPLICATION

This is a continuation under 35 U.S.C. §120 of Ser. No. 11/718,084 filed Jun. 6, 2007, which is a 35 U.S.C. §§371 national phase conversion of PCT/EP2005/010130, filed Sep. 20, 2005, which claims priority of Austrian Application No. AT1823/2004, filed Oct. 29, 2004, all incorporated herein by reference. The PCT International Application was published in the German language.

BACKGROUND OF THE INVENTION

The invention relates to a method for producing a cast steel strip of preferably hot crack-sensitive or hot-brittle steel quality by means of a strip casting plant and to a strip casting plant for carrying out this method.

The strip casting plant is preferably a two-roll casting plant with two casting rolls arranged with their axes of rotation in a horizontal plane.

In contrast to carbon steels with a low C-content (C-content <0.20% by weight, in particular C<0.08%) and austenitic steel qualities, carbon steels with higher C-contents, electric steels and, in part, also ferritic and martensitic steel qualities tend to hot brittleness or hot crack sensitivity in temperature ranges above approximately 1150-1250° C. and upward. Developed casting methods use a strip casting plant, in particular a two-roll casting plant, in which the steel strip leaves the strip forming cross section between the two casting rolls, what is known as the kissing point, vertically downward and forms a largely freely suspended strip loop or in a suspended arc that strip is transferred, without appreciable strip support, into a horizontal transport direction at a relatively great distance from the casting rolls. In the case of hot crack-sensitive steel qualities, this leads to increased (intercrystalline) crack formation on the strip surface. Especially due to the dead weight of the sagging hot steel strip and on account of oscillatory movements or stochastic movements and strip tensile forces, this tendency is promoted.

To avoid such harmful influences on the still hot steel strip, methods have already been proposed which avoid a freely suspended loop of this kind. In a casting method improved in this way, using a vertical two-roll casting plant, steel melt is conducted in a melt space formed by two casting rolls and two side plates. The slab shells formed in the melt space on cooled surface areas of the casting rolls are brought together in the strip forming cross section between the casting rolls to form an at least partly solidified steel strip. In this case, the cast steel strip is guided along the surface area of one of the two casting rolls from a vertical casting direction into an essentially horizontal transport direction and is supplied essentially horizontally on a transport device to a strip winding device and is wound there into a coil. A method of this type is already known from JP-A 1-087045.

In this known casting method, the steel strip guided over an arc of a quarter circle along one of the casting rolls is treated in a shaping manner by a working roll capable of being thrown onto the casting rolls. Strip tensile forces occurring in this case induce mostly fluctuating tensile stresses in the steel strip which react into the strip forming cross section, which is conducive to hot crack formation.

Two-roll casting plants with strip guidance along a surface area of one of the two casting rolls are already known, further, from JP-A 2-247049, JP-A 2-295649, JP-A 2-290651 and JP-A 1-133651. In these strip casting plants, the casting roll guiding the cast strip is always assigned a pressing roll or a driver roll, which presses the strip onto the casting roll and, with a strip tension being applied, is moved in close contact with the casting roll. Here, too, the strip tension may possibly react into the strip forming cross section and is likewise conducive to hot crack formation.

SUMMARY OF THE INVENTION

The invention is aimed at avoiding these disadvantages and difficulties and has set the object of proposing a method for producing a cast steel strip of preferably hot crack-sensitive steel quality and a strip casting plant for implementing this method, the cast steel strip being guided from the strip forming cross section as far as the essentially horizontal transport device so as to be largely free of strip pressing or strip deformation forces acting on the steel strip (for example, due to thickness reductions, drivers).

This object is achieved by means of a method of the type initially outlined, in that the cast steel strip, during its transport movement along the surface area of one of the two casting rolls, is guided in a transport channel without the local application of pressure forces or of deformation forces influencing the strip thickness, and, in this transport channel, strip cooling in a range of 15 K/s to 200 K/s takes place. According to a preferred embodiment, the most favorable strip cooling rate is in a range of 15 K/s to 100 K/s. Owing to the combination of strip transport with minimized extraneous stress load in the steel strip by the avoidance of mechanical actions on the steel strip caused by devices of the strip casting plant and of a temperature management of the solidification process coordinated with the respective steel quality, the formation of fine intercrystalline cracks can be reduced substantially. In any event, it is necessary to prevent strip tensile stresses from reacting into the range of the temperature zone prone to hot cracks. Depending on the steel quality to be cast, this temperature zone lies above 1150° C. to 1250° C., in particular between the ZST temperature (zero strength temperature) and the ZDT temperature (zero ductility temperature), hence in a temperature range above and below the respective solidus temperature.

Especially careful strip guidance is achieved when the cast steel strip is guided from a vertical casting direction into an essentially horizontal transport direction in touch contact with the surface area of one of the two casting rolls.

To optimize the surface quality of the cast steel strip and especially to avoid scale formation, particularly in terms of an inline rolling process with only low or no descaling requirements, it is proposed that the cast steel strip, during its transport movement along one of the surface areas of the casting rolls, be guided in an atmosphere with an oxygen content reduced in respect of air or in a largely oxygen-free protective gas atmosphere. In this case, it is considered to be a sufficient measure if the oxygen content of the atmosphere is set at less than 8% oxygen, preferably less than 1% oxygen.

In order to avoid or ensure reactions of strip transport and strip treatment devices on the steel strip moved in the transport channel along one casting roll, it is expedient if the cast steel strip, after running through the transport channel and after moving away in translation from the surface area of the casting roll, is guided essentially horizontally on a transport device over a distance of at least 1 m, preferably more than 2 m. Over this distance, for example, strip tensile forces arising from the weight forces of a following strip loop, a strip driver or reaction forces from a roll stand can be broken down continuously opposite to the strip transport direction, so that the steel strip leaves the transport channel in the region of the lower vertex of the casting roll so as to be largely free of undesirable extraneous loads.

Preferably, the cast steel strip, after an essentially horizontal transport movement, forms a strip loop, and, starting from this strip loop, a reacting strip tension is introduced into the cast steel strip. Consequently, on the one hand, stable strip guidance from the strip forming cross section as far as the strip loop and, on the other hand, a decoupling of the casting process from treatment steps in following strip treatment devices are achieved.

By a strip loop being arranged after the horizontal transport distance in a sufficient length, there is the possibility that a strip tension in the cast steel strip, preferably in a region of the lower vertex of the casting roll, is controlled or regulated by the dead weight of the strip loop. The dead weight of the strip loop is in this case determined via a position measurement of the strip loop and is used as a control variable. Likewise, the strip tension in the cast steel strip, preferably in a region of the lower vertex of the casting roll, can be influenced in a directional way by influence being exerted on the friction and speed ratios between the steel strip and the transport device. This may preferably be achieved in that, during an essentially horizontal transport movement on a strip transport means, strip tensile stresses or strip compressive stresses reacting as far as the casting roll are introduced into the steel strip by a clamping force, and this clamping force applied along a path segment to that end of the transport means which lies in the transport direction of the steel strip. The strip tension in the cast steel strip is set by the application of the clamping force and is used as a control variable. Interaction of a plurality of control variables is also possible.

Particularly stable conditions in strip guidance can be achieved if the strip tension is set in the region of the lower vertex of the casting roll to a value at which the steel strip bears against the casting roll, essentially free of slip, over essentially the entire arc of a quarter circle. The strip tension at the lower vertex is in this case to be kept so low that only strip fluttering in the transport channel is prevented, but, furthermore, no substantial additional strip tensile forces are to react into the strip forming cross section.

The mean strip cross-section temperature at the end of a first essentially horizontal transport movement of the metal strip is 60° C. to 250° C. lower than in the strip forming cross section, that is to say the range of hot brittleness is already essentially undershot or overcome at this point.

It is expedient if the steel strip, after leaving the curved transport channel, is supplied for further treatment in a horizontal transport movement without any further bending stress. In this case, this essentially horizontal transport movement of the steel strip may comprise deviations of +/−15° with respect to the horizontal.

To produce a rolled hot strip with a crystalline structure, strip mid-thickness and surface quality which are largely uniform over the strip length and strip width, the cast steel strip is subjected to an at least single-step strip thickness reduction in an inline rolling process before being wound up in the strip winding device.

There are several possibilities for starting the casting process on the strip casting plant according to the invention:

According to a first possible procedure, before a casting operation is started, a cold strip is introduced into the strip casting plant, preferably in the opposite direction to the strip transport direction of the cast strip, closes the strip forming cross section between the casting rolls and extends in the strip transport direction as far as a strip transport means on an essentially horizontally oriented transport device or up to and above the loop pit where it is separated from the cast steel strip preferably by means of cross-cutting shears.

According to a second possible procedure, the starting of a casting operation takes place without a dummy slab, a first portion of the cast steel strip being conveyed out of the transport channel in a vertical movement and, under the load of the dead weight of this first portion in the strip forming cross section or in the transport channel shortly after the strip forming cross section, being separated from the following steel strip, and the following cast steel strip being conducted along the surface area of one of the two casting rolls in said transport channel into an essentially horizontal transport direction. A starting method for a strip casting plant without using a dummy slab, such as is employed, here too, in its basic principles, is already described in detail in WO 2004/028725. The adjustment, optionally necessary during the starting operation, of the casting thickness by means of the casting rolls or of the casting speed may conform to the operating method proposed in WO 2004/028725.

Further, a strip casting plant for producing a cast steel strip of predetermined strip thickness and of preferably hot crack-sensitive or hot-brittle steel quality is proposed. This strip casting plant is comprised of two rotary-driven casting rolls with internally cooled surface areas and of two sideplates which can be pressed against and thrown onto the casting roll end faces and which jointly form a melt space for the reception of steel melt and a strip forming cross section for the steel strip to be cast, of an essentially horizontally oriented transport device for the steel strip deflected along one of the surface areas out of the vertical casting direction into an essentially horizontal transport direction in a transport channel and of a following strip winding device. To achieve the set object, the strip casting plant is characterized in that one of the two casting rolls is assigned a strip guide device which with the surface area of this casting roll forms a transport channel for the cast steel strip, and the two cooperating casting rolls are equipped with internal cooling devices activatable independently of one another.

According to an expedient embodiment, the strip guide device is assigned to one of the two casting rolls between the strip forming cross section and the transport device, and supporting elements of the strip guide device are arranged according to and as a function of the strip thickness at an essentially equal distance from the surface area of the casting roll and with the surface area of one casting roll form a transport channel for the cast steel strip.

The strip guide device, with the supporting elements assigned to it, forms, together with the surface area of the casting roll, a transport channel for the cast, still hot steel strip and is designed such that the steel strip is not impeded on its way through the transport channel, that is to say is not braked by any contacts with elements of the strip guide device and also is not exposed to any relevant acting loads, such as pressure forces of guide or even driver rolls or frictional forces of braking components. The steel strip may, on the other hand, come into slight kissing contact with the surface of the casting roll, so that a sufficient cooling of the steel strip by the transmission of contact heat is achieved. The clear width of the transport channel is therefore slightly greater than the thickness of the cast steel strip. On account of the different thermal load on the two cooperating casting rolls, these are equipped with separately regulated coolant circuits. Largely identical thermal conditions for the formation of slab shells of equal thickness are consequently achieved on both casting roll surface areas.

Expediently, the transport channel for the cast steel strip is arranged within an insulating chamber for maintaining a predetermined atmosphere. Consequently, both a reoxidation of the steel strip surface is largely avoided and the thermal conditions in the transport channel and therefore also the temperature distribution in the metal strip are equalized.

A structurally simple solution arises when the transport channel for the cast steel strip forms, at least in a part region, a wall element of the insulating chamber, or the strip guide device forms, in a part region, a structural unit with wall elements of the insulating chamber.

The transport channel for the cast steel strip covers essentially an arc of a quarter circle along the surface area of the casting roll. The cast steel strip can consequently be discharged directly onto a horizontal transport device.

The clear width of the transport channel is equal to or greater than the thickness of the cast steel strip. If the clear width of the transport channel is largely equal to the thickness of the metal strip, it is necessary to form the supporting elements by nondriven supporting rolls which are preferably supported resiliently in the strip guide device so as not to introduce any reaction forces into the metal strip.

To ensure an easy start of casting of the strip casting plant, the strip guide device has, vertically below the strip forming cross section formed by the casting rolls or below the casting roll forming the transport channel, a passage orifice for a dummy piece of the cast steel strip, said passage orifice being closeable by means of a closing device. This closing device consists preferably of a flap pivotable about a horizontal axis. A first slab piece, which is separated as a reject piece from the following strip, can thus be conveyed vertically downward out of the strip casting plant, without having to be guided through the entire narrow transport channel. Damage to the strip guide device and, in particular, to the casting roll surface is thus also avoided.

Expediently, the components of the strip guide device which are subjected to high thermal load are equipped with internal cooling devices.

The essentially horizontally oriented transport device adjoining the transport channel at the lower vertex of the casting roll has a longitudinal extent of at least 1 m, but preferably of at least 2 m, but should not exceed 6 m, so that, in the production of thicker strips, an excessive cooling of the steel strip is avoided at a lower casting and transport speed. The transport device may be arranged at an inclination of up to +/−15° with respect to the horizontal.

To set a strip tension, the transport device comprises driven rollers or pairs of rollers. In the region of the transport device, the metal strip is already cooled to an extent such that the metal strip can be exposed to a sufficient pressing force without the risk of being torn off or an increased risk of crack formation on the strip surface.

A strip store preferably designed as a loop pit adjoins the essentially horizontally oriented transport device. According to a special embodiment, the entry region into the strip store and the exit region out of the strip store are configured such that an asymmetric strip loop occurs in the strip store. This is implemented in that the strip store comprises an entry region into the strip store and an exit region out of the strip store, and the exit region out of the strip store is lowered with respect to the entry region into the strip store. A bridging chute pivotable inward and outward is arranged between the entry region to the strip store and the exit region out of the strip store, and what is achieved by this bridging chute is that, in casting without a cold strip, the leading edge of the cast steel strip reliably overcomes the loop pit by means of gravitational support on the pivoted-up bridging chute.

To produce a rolled hot strip with a crystalline structure and surface quality which are uniform over the strip length, the strip winding device is preceded by at least one roll stand, and the at least one roll stand is assigned a strip deflection device. If required, the first roll stand is additionally preceded by a temperature compensation device.

In order largely to suppress scaling on the steel strip until it enters the roll stand, a continuous or segmented insulating chamber surrounding the transport path of the steel strip is arranged between the casting rolls and the first roll stand. Alternatively, this insulating chamber surrounding the transport path of the steel strip may also end at an earlier stage and, for example, extend only along the transport path between the casting rolls and the exit region out of the strip store. A segmentation of the insulating chamber is expedient when additional assemblies, such as drivers, cooling zones or profile meters, are arranged in the region of extent of the insulating chamber.

BRIEF DESCRIPTION OF THE DRAWINGS

Further advantages and features of the present invention may be gathered from the following description of nonrestrictive exemplary embodiments, reference being made to the accompanying FIG. 1 which shows a longitudinal section through a strip casting plant of the type according to the invention.

DESCRIPTION OF A PREFERRED EMBODIMENT

Figure 1:
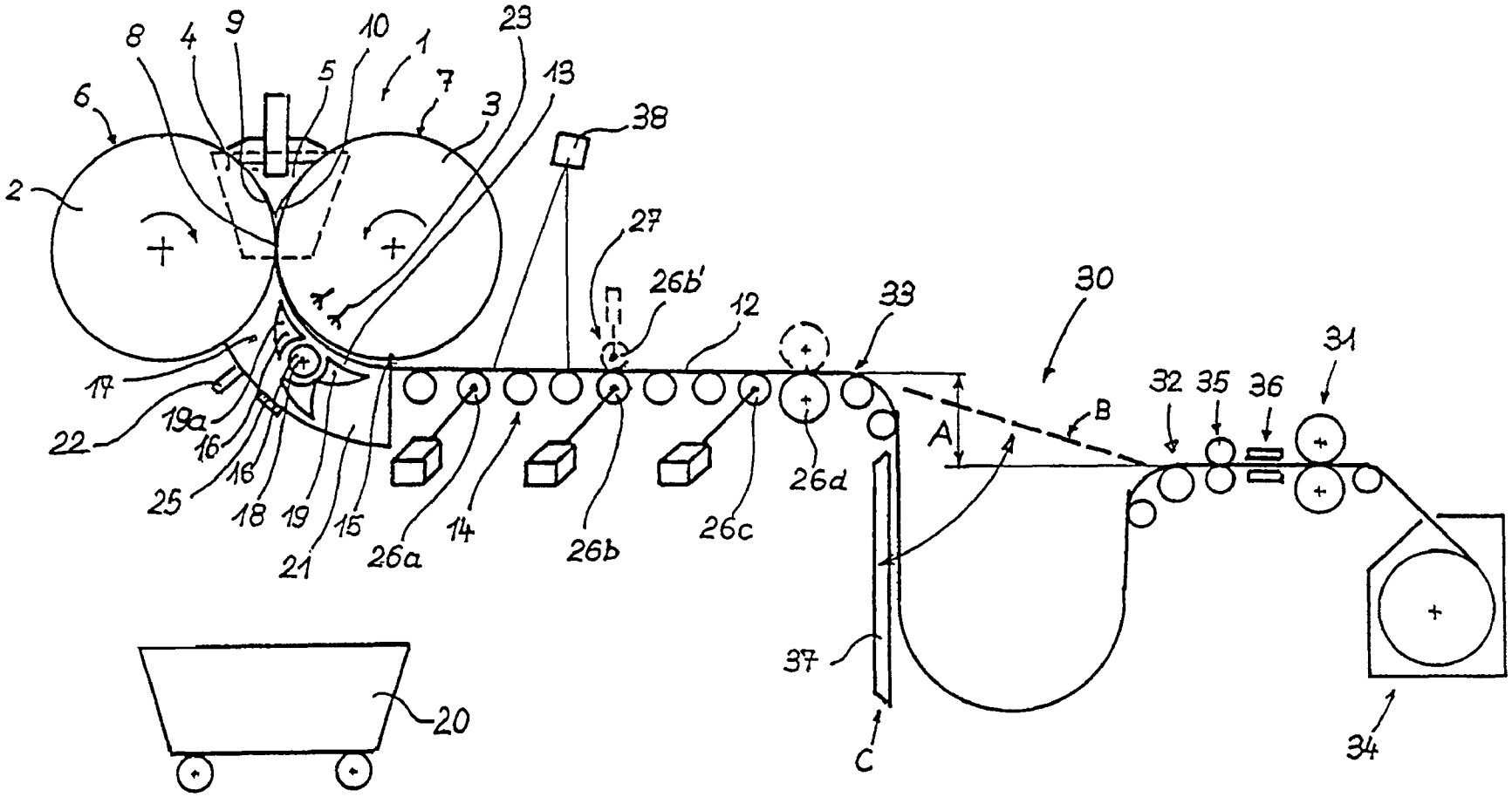

FIG. 1 illustrates diagrammatically, in a plant longitudinal section, a strip casting plant for producing a thin hot-rolled steel strip of hot crack-sensitive steel quality.

The strip casting plant comprises a two-roll casting plant 1 with two driven casting rolls 2, 3 which rotate contradirectionally and which, together with two sideplates 4 which bear against the casting rolls on the end faces of the latter and one of which is illustrated by dashed lines, form a melt space 5 for the reception of steel melt and, in the narrowest cross section between the surface areas 6, 7, the strip forming cross section 8. On the surface areas 6, 7 of the internally cooled casting rolls, said surface areas dipping continuously into the steel melt, slab shells 9, 10 with a continuously growing slab shell thickness develop during the rotation of the casting rolls.

The steel strip 12 of defined width and thickness conveyed out of the strip forming cross section 8 due to the rotational movement of the casting rolls is supplied in a transport channel 13, over an arc of a quarter circle of the casting roll 3, to a transport device 14 which directly adjoins the transport channel 13. The transport channel 13 extends along the surface area 7 of the casting roll 3 essentially from the strip forming cross section 8 as far as the lower vertex 15 of the casting roll 3. The transport channel is delimited by the rotating surface area 7 of the casting roll 3 and by supporting elements 16 of a strip guide device 17. The supporting elements 16 are in this case formed by nondriven internally cooled supporting rolls 18, only one of which is illustrated, or by movable runners 19. The combination of these embodiments makes it possible in a simple way to take into account special operating conditions, for example the vertical discharge of a first steel strip piece out of the transport channel, directly after the start of casting, into a prepared scrap carriage 20 below the casting roll 3 coforming the transport channel 13. A runner 19 designed as a pivotable flap **19*a*, in conjunction with a passage orifice 25, allows this vertical outward conveyance of a dummy piece of the cast steel strip, for example in the starting phase of the casting process or in the event of other brief production interruptions required. By the pivotable flap 19***a* being thrown onto the surface area 7 of the casting roll 3, on the other hand, a "peeling off" of the steel strip from the surface area can take place when the steel strip is caught on the latter.

The individual components of the strip guide device 17 equipped with cooling devices are connected together with wall elements, not illustrated in any more detail, of the transport channel 13 by means of a frame structure, likewise not illustrated in any more detail, to form a functional subassembly. The strip guide device 17 and consequently the transport channel 13 are surrounded by an insulating chamber 21 or are integrated structurally into the latter. The insulating chamber bears with sealing elements, not illustrated, against the casting rolls and with the casting rolls 2, 3 forms a space which is delimited from the ambient atmosphere and in which a protective gas atmosphere can be set and maintained. The insulating chamber 21 is connected to a protective gas supply line 22. Largely oxygen-free gases are used as protective gases.

Temperature management in the steel strip, coordinated with the respective steel quality of the steel strip to be cast, takes place predominantly by the discharge of heat via the surface area of the casting roll 3, this heat discharge being controlled by an internal cooling device 23 in the casting roll 3. It is therefore expedient if the steel strip bears against the surface area 7 of the casting roll 3, but without being pressed onto this surface area or being highly tensioned due to the application of a high strip tension over the arc of a quarter circle.

The internal cooling devices of the two casting rolls 2, 3 must conform to different requirements. Both casting rolls have the task of forming on their surface area slab shells having the same growth development. For this purpose, as identical cooling conditions as possible must be set over the casting period in the contact regions of the steel melt with the casting roll surface area. In addition, on one of the casting rolls 3, an additional discharge of heat out of the steel strip through the surface area of the casting roll must be made possible along the arc of a quarter circle between the strip forming cross section and the lower vertex of the casting roll. The cooling power of the casting roll 3 must be designed accordingly.

The transport channel 13 has adjoining it directly, in the region of the lower vertex of the casting roll 3, a transport device 14 which runs horizontally and is designed as a roller table of conventional type of construction with a roller conveyor. In the transitional region from the transport channel 13 to the transport device 14, the steel strip is straightened and comes out of slight contact with the casting roll. Three rollers are designed as driven rollers 26*a*, 26*b*, 26*c* and ensure the continuous transport of the steel strip at the casting speed. By the rotational speed of the driven rollers 26*a* to 26*c* being regulated, the strip tension at the lower vertex 15 of the casting roll 3 is set at a value which ensures that the metal strip bears slightly against the surface area 7 of the casting roll 3, but gives rise to scarcely any reactions in terms of strip tensile stresses in the steel strip in the region of the arc of a quarter circle between the strip forming cross section 8 and the lower vertex 15. According to a further embodiment, illustrated by dashed lines, a driven roller 26*b* may form with a throw-on roller 26*b*' a pair of rollers 27 and ensure slip-free regulated strip transport.

The transport device 14 has adjoining it in the strip running direction a strip store 30 which is designed as a loop pit and by means of which a decoupling of the casting process from following strip treatment steps, such as thickness reduction in a roll stand 31, takes place. This dispenses with a permanent synchronization of the casting speed and rolling speed, and the strip tension necessary for the rolling operation can be built up, without reaction on the casting process, on the exit side of the loop pit. The strip store is dimensioned such that differences between the casting speed and rolling speed can easily be smoothed out. The horizontal loop pit exit region 32 is lowered by the amount of the distance A with respect to the horizontal loop pit entry region 33, with the result that an asymmetric loop is formed.

Between the loop pit entry region 33 and the loop pit exit region 32 is arranged a bridging chute 37 which bridges the loop pit 30 and is designed pivotably. The bridging chute is coupled to a pivoting drive, not illustrated, and can be pivoted from a position B bridging the loop pit into a position C opening the loop pit, and back again. Thus, for example, when the strip casting plant is started without the use of a dummy slab, the leading edge of the steel strip produced is transported with gravitational support via the bridging chute directed obliquely downward in the strip transport direction.

In the loop pit entry region 33 is arranged a large driven roller 26*d* which may be assigned an upper roller, so that, in contrast to a sole build-up of strip tensile stresses in the steel strip as a consequential effect of a strip loop in the loop pit, in addition to the influence due to the strip loop or instead of this, strip tensile stresses or strip compressive stresses can be introduced into the steel strip which reach back at least partially as far as the casting roll.

In a single roll stand 31, preceded by a strip deflection device 35 and a temperature compensation device 36, the cast steel strip is reduced to a final hot strip thickness and a rolled crystalline structure is established in the steel strip. The steel strip is subsequently wound in a strip winding device 34 into coils having a predetermined target weight. The strip winding device is preceded by cross-cutting shears.

To monitor the cast steel strip leaving the two-roll casting plant, a CCD camera 38 is positioned in the initial region of the horizontal transport device 14.

Exemplary Embodiment:

To produce a steel strip with a casting thickness of 2.0 mm and with a strip width of 1500 mm, a steel melt of quality C45 with a melt temperature of about 1550° C. is introduced from a distributor vessel, in which a substantial separation of melt-foreign particles takes place, into the melt space of the two-roll casting machine. The surface areas of the two casting rolls dip with a surface temperature of approximately 60-100° C. and at a rotational speed corresponding to a casting speed of approximately 90 m/min into the steel melt, there being formed on the internally cooled surface areas slab shells which are moved together with the surface areas and, when the strip forming cross section is reached, have grown in sum to about the strip thickness and are combined there into a largely fully solidified strip. At a temperature which lies in a range of 1400-1430° C. just below the solidus temperature of this steel quality, the steel strip enters the transport channel and, within the transport channel formed by an arc of a quarter circle, is cooled at a cooling rate of approximately 45° K/s to a temperature of about 1365° C.±20 K at the lower vertex of the casting roll. A crystalline structure which is characterized by ferritic grains is in this case formed.

In the transport channel, the steel strip runs through a protective gas atmosphere, the latter being formed predominantly by nitrogen, even small quantities of $O_2$, $H_2$, Ar and further natural noble gases being present.

On the transport device, the steel strip is cooled further by radiation and strip contact with the transport rollers, and a strip tension is applied to the steel strip which ensures that the steel strip bears against the surface area of the casting roll in the transport channel, without a substantial strip tension taking effect in this region. Strip cooling in the region of the transport device may be assisted by additional gas cooling.

After running through the strip store, the steel strip is reduced in thickness by 15-50% in a roll stand at a strip entry temperature of 900-1050° C. and is subsequently wound at 500-850° C. into coils in a strip winding device.

What is claimed is:

1. A method for producing a cast steel strip by a strip casting plant, comprising conducting steel melt into a melt space formed by and between two casting rolls and by and between two side-plates at the casting rolls, forming slab shells in the melt space by cooling surface areas of the casting rolls and bringing the slab shells together in a strip forming cross section between the casting rolls to form an at least partly solidified steel strip, guiding the cast steel strip along the surface area of one of the two casting rolls from a vertical casting direction out of the melt space into an essentially horizontal transport direction and away from the one casting roll, the one casting roll being on the side of the melt space in the horizontal transport direction, and transporting the cast steel strip being supplied essentially horizontally on a transport device to a strip winding device and there winding the strip into a coil, wherein during guiding of the cast steel strip in the essentially horizontal transport direction, the cast steel strip continues to be guided along the surface area of the one of the two casting rolls while guiding the cast steel strip through a transport channel located below the one of the two casting rolls without pressing the steel strip against the surface area of the one of the two casting rolls, and, in the transport channel, cooling the strip in a range of 15 K/s to 200 K/s, and setting a strip tension in the region of a lower vertex of the one casting roll to a value at which the steel strip bears against the one casting roll, essentially free of slip, over essentially the entire arc of a quarter circle around the one casting roll.

2. The method as claimed in claim 1, wherein during transport movement of the cast steel strip along one of the surface areas of the casting rolls, the strip is guided in an atmosphere with an oxygen content reduced in respect of air or in a largely oxygen-free protective gas atmosphere.

3. The method as claimed in claim 2, wherein the oxygen content of the atmosphere is set at less than 8% oxygen.

4. The method as claimed in claim 1, wherein after the cast steel strip runs through the transport channel and moves in translation away from the surface area of the casting roll, the strip is guided essentially horizontally over a distance of at least 1 m.

5. The method as claimed in claim 1, wherein after the cast steel strip transports essentially horizontally, permitting the strip to form a strip loop, and, starting from this strip loop, introducing a reacting strip tension into the cast steel strip.

6. The method as claimed in claim 5, further comprising controlling or regulating a strip tension in the cast steel strip in the region of the lower vertex of the casting roll by the dead weight of the strip loop.

7. The method as claimed in claim 1, wherein during an essentially horizontal transport movement, including strip tensile stresses or strip compressive stresses reacting as far as the casting roll into the steel strip by applying a clamping force along a path segment to the end of the transport in the transport direction of the steel strip.

8. The method as claimed in claim 7, further comprising setting a strip tension in the cast steel strip by applying a clamping force to the steel strip.

9. The method as claimed in claim 1, wherein a mean strip cross-section temperature at the end of a first essentially horizontal transport movement of the metal strip is 60° C. to 250° C. lower than in the strip forming cross section.

10. The method as claimed in claim 1, wherein the essentially horizontal transport movement of the steel strip comprises deviations of +/−15° with respect to the horizontal.

11. The method as claimed in claim 1, further comprising subjecting the cast steel strip to an at least single-step strip thickness reduction before winding up the strip in the strip winding device.

12. The method as claimed in claim 1, further comprising before starting a casting operation, introducing a cold strip into the strip casting plant which closes the strip forming cross section between the casting rolls and extends in the strip transport direction or on an essentially horizontally oriented transport device or up to and above a loop pit and there separating the cold strip from the cast steel strip.

13. The method as claimed in claim 1, further comprising starting a casting operation without a dummy slab, conveying a first portion of the cast steel strip out of the transport channel in a vertical movement and, under a load of the dead weight of the first portion in the strip forming cross section or in the transport channel shortly after the strip forming cross section, separating the first portion from the following steel strip, and conducting the following cast steel strip along the surface area of one of the two casting rolls and in a transport channel and into an essentially horizontal transport direction.

14. The method as claimed in claim 3, wherein the atmosphere is set at less than 1.0% oxygen.

15. The method as claimed in claim 4, wherein the strip is guided essentially horizontally for more than 2 m.

16. The method as claimed in claim 8, wherein the strip tension is set in a region of the lower vertex of the casting roll.

17. The method as claimed in claim 1, wherein the temperature of the cast steel strip in the transport channel is above 1150° C. to 1250° C.

18. The method as claimed in claim 1, wherein the cast steel strip comprises a carbon steel with a higher carbon content than carbon steels of carbon content less than 0.20% by weight.

* * * * *